US005604355A

United States Patent [19]

Van Zutphen

[11] Patent Number: 5,604,355

[45] Date of Patent: Feb. 18, 1997

[54] ELECTRON TUBE COMPRISING A SEMICONDUCTOR CATHODE

[75] Inventor: Tom Van Zutphen, Eindhoven, Netherlands

[73] Assignee: U.S. Philips Corporation, New York, N.Y.

[21] Appl. No.: 442,565

[22] Filed: May 16, 1995

Related U.S. Application Data

[62] Division of Ser. No. 152,563, Nov. 12, 1993, Pat. No. 5,444,328.

[30] Foreign Application Priority Data

Nov. 12, 1992 [EP] European Pat. Off. ..... 92203475

[51] Int. Cl.[6] ..... H01J 29/04

[52] U.S. Cl. ..... 257/10; 257/488; 257/491; 313/446; 313/495

[58] Field of Search ..... 257/213, 10, 11, 257/629, 488, 491, 487; 313/444, 446, 447, 458, 499, 497, 45

[56] References Cited

U.S. PATENT DOCUMENTS

| | | | |
|---|---|---|---|
| 4,259,678 | 3/1981 | Van Gorkum et al. | 257/10 |
| 4,303,930 | 12/1981 | Van Gorkom et al. | 357/13 |
| 4,352,117 | 9/1982 | Cuomo et al. | 257/11 |
| 4,574,216 | 3/1986 | Hoeberechts et al. | 315/446 X |
| 4,682,074 | 7/1987 | Hoeberechts et al. | 257/10 |
| 4,801,994 | 1/1989 | Van Gorkom et al. | 257/10 |
| 5,285,079 | 2/1994 | Tsukamoto et al. | 257/11 |
| 5,315,207 | 5/1994 | Hoeberechts et al. | 257/10 |

FOREIGN PATENT DOCUMENTS 2109160 5/1983 United Kingdom .

*Primary Examiner*—Donald L. Monin, Jr.
*Attorney, Agent, or Firm*—John C. Fox; Norman N. Spain

[57] ABSTRACT

By providing a semiconductor device such as a cold cathode (7) with extra zener or avalanche structures (26, 27 and 32, 33, respectively) a robust structure is obtained which is resistant to damage during manufacture and use of a vacuum tube. The semiconductor zones (26, 27, 32, 33) are thus also utilized for realizing electron optics (particle optics).

2 Claims, 4 Drawing Sheets

ELECTRON TUBE COMPRISING A SEMICONDUCTOR CATHODE

Figure 1:
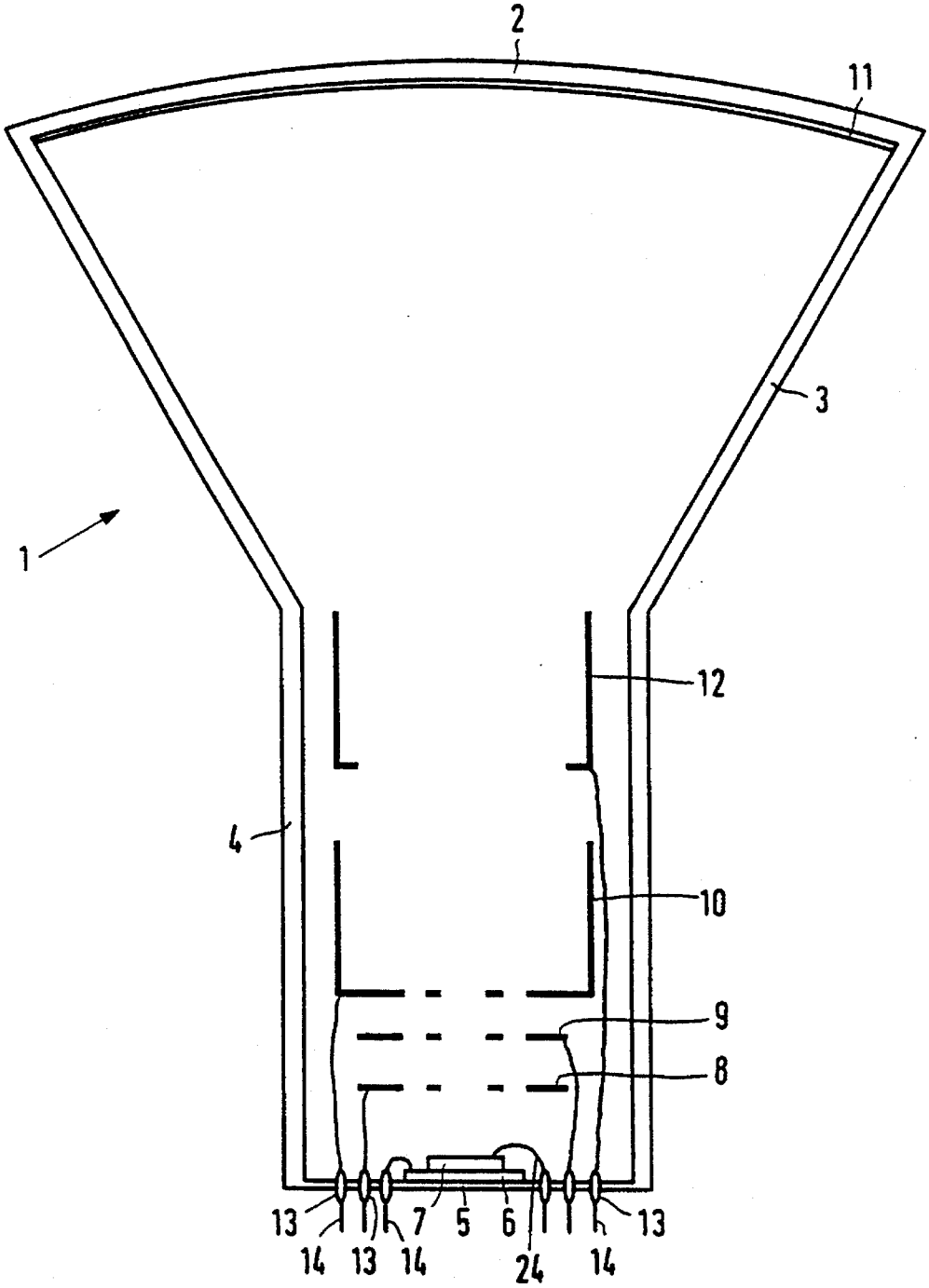

This is a division of application Ser. No. 08/152,563, filed Nov. 12, 1993, now U.S. Pat. No. 5,444,328.

The invention relates to an electron tube comprising a semiconductor device for generating electrons, which device has a semiconductor body with a structure adjacent to a main surface in the semiconductor body, in which structure electrons to be emitted from the semiconductor body at the location of an emissive surface region can be generated by applying suitable voltages.

The invention more generally relates to a vacuum robe comprising a semiconductor device for influencing charged particles.

The electron tube may be used as a display tube or a camera tube, but it may alternatively be adapted, for example, for electrolithographic applications or electron microscopy.

The invention also relates to a semiconductor device for generating electrons or ions and for influencing their paths.

An electron tube of the above-mentioned type is described in U.S. Pat. No. 4,303,930 (PHN 9.532). In the semiconductor device, which is a "cold cathode", a pn junction is reverse biased in such a way that there is avalanche multiplication of charge careers. Some electrons may then acquire-as much kinetic energy as is necessary for exceeding the electron work function. The emission of these electrons is simplified by providing the semiconductor device with acceleration electrodes or gate electrodes on an insulating layer located on the main surface, which insulating layer leaves an aperture at the location of the emissive region. Emission is still further simplified by providing the semiconductor surface at the location of the emissive region with a material reducing the work function such as, for example cesium.

If such a cathode is built into an electron tube, problems occur in the further manufacturing process. During the process, which is known as spot-knocking, a number of grids in the tube acquire a high to very high voltage (100 kV to 30 kV) while the substrate and the gate electrode(s) of the semiconductor cathode are, for example grounded. During this spot-knocking operation flashovers are produced so that the grid located closest to the cathode acquires a high voltage (approximately 10 to 30 kV) instead of a comparatively low voltage (approximately 100 V). Such a flashover may also occur during normal use.

The connection wires of the substrate as well as the gate electrodes cannot, however, be considered as purely ohmic connections but have a given inductance. This results in a large voltage difference between the substrate and the gate electrode due to capacitive crosstalk between said grid and, for example this substrate. This voltage difference is also dependent on the inductances of the connection wires, the resistance of, for example the material of the gate electrode and the duration of the flashover. Usually, this difference is, however, so large that there is a destructive breakdown of the insulating layer between the gate electrode and the subjacent substrate. As a result, electron tubes comprising this type of cold cathodes are often rejected, notably during the spot-knocking process.

Moreover, the insulating layer between the gate electrode(s) and the substrate may be charged during use due to, for example secondary emission effects and may have a detrimental effect on the shape or direction of the emissive electron beam.

It is, inter alia an object of the invention to provide an electron tube in which a solution to the above-mentioned problems is obtained. It is another object of the invention to provide semiconductor cathodes which are substantially insensitive to said flashovers.

A further object of the invention is to provide an electron or vacuum tube in which electron optics (or, more generally, particle optics) are realised by means of a semiconductor device.

The invention is based on the recognition that this can be achieved by providing the electron tube with an extra semiconductor device (or by providing the semiconductor device with an extra structure) which limits the voltage generated by a flashover at the location of a gate electrode in such a way that destructive breakdown is prevented.

The invention is further based on the recognition that said problem can be obviated by no longer realising the electron optics at the location of the semiconductor device by means of gate electrodes but by means of surface zones in the semiconductor region, which zones are separated from the electron emissive structure and form part of a structure protecting the semiconductor body from destructive breakdown when a flashover occurs.

To this end an electron tube according to the invention is characterized in that for electron-optically influencing the electrons the semiconductor body comprises adjacent to the main surface at least one second structure having a first surface region of a first conductivity type which is at least partly surrounded by a second surface region which is of a second, opposite conductivity type or is substantially intrinsic.

The surface regions form part of a horizontal or a vertical structure so that conductance is possible (aim possibly in a breakdown situation). A sudden rise of the voltage at the surface can thus be compensated by these structures. Simultaneously the region of the first conductivity type may have a constant potential during use and thus fulfil a similar function as the gate electrode or other deflection electrodes. If necessary, these regions may, however, be fully or partly metallized if this is more advantageous from an electron-optical point of view. Since the insulating layer may be dispensed with in this case, this layer cannot be charged either.

Dependent on their doping, dimensions and the applied voltages, the semiconductor zones which are freely located at the surface may fulfil an electron-optical (or particle-optical) function. The particles to be influenced by these optics may be generated within the semiconductor body as well as outside this body. In the latter case the semiconductor body has, for example an aperture for passing particles whose paths are influenced by the particle optics generated in the semiconductor body.

To ensure that the actual electron-emissive structure is free from currents during and as a result of breakdown of the structures in the lateral direction, a first preferred embodiment is characterized in that the distance between the first and the second structure is larger than the width of the depletion layer associated with the breakdown voltage of the second structure. This can be realised in a simple manner by forming the second structure as a zener diode or as an avalanche diode.

During use the second structure preferably does not convey substantially any current. In practice this structure may be designed in such a way that the breakdown voltage is larger than the operating voltage between the (highly doped) first surface region and the emissive surface region.

If said first surface region is of the n type, it acquires a positive voltage during use; if it is of the p type, it will acquire a negative voltage during use. If the surface region is circular, the emitted beam of electrons will then be influenced by the voltages and, for example converge or diverge, dependent on the location of these regions. In practice, however, combinations of convergent and divergent beams or deflecting beams may have to be generated. To achieve this, a further embodiment according to the invention is characterized in that for electron-optically influencing the electrons the main surface of the semiconductor body comprises at least one third structure having a first surface region of the second conductivity type which is surrounded by a second surface region which is weakly doped and of the first, opposite conductivity type or is substantially intrinsic.

The principle of the invention in relation to the prevention of breakdown may alternatively be realised in an embodiment in which the gate electrode(s) or acceleration electrodes are provided on an insulating layer, as described in U.S. Pat. No. 4,303,930, and the electron tube comprises one or more cold cathode(s) as described in this Patent but also separate semiconductor structures (such as, for example zener diodes) protecting against breakdown which are mounted, for example jointly with the cold cathode(s) on a support.

The principle of realising particle optics by means of semiconductor devices can be more generally used in a vacuum tube comprising a semiconductor device for influencing a path of charged particles and is characterized in that the semiconductor body has a region for generating charged particles or an aperture for passing charged particles and that for influencing the path of charged particles at least one main surface has at least one structure with a first surface region of a first conductivity type which is at least partly surrounded by a second surface region of a second, opposite conductivity type or is substantially intrinsic.

These and other aspects of the invention will be apparent from and elucidated with reference to the embodiments described hereinafter.

In the drawings

Figure 2:
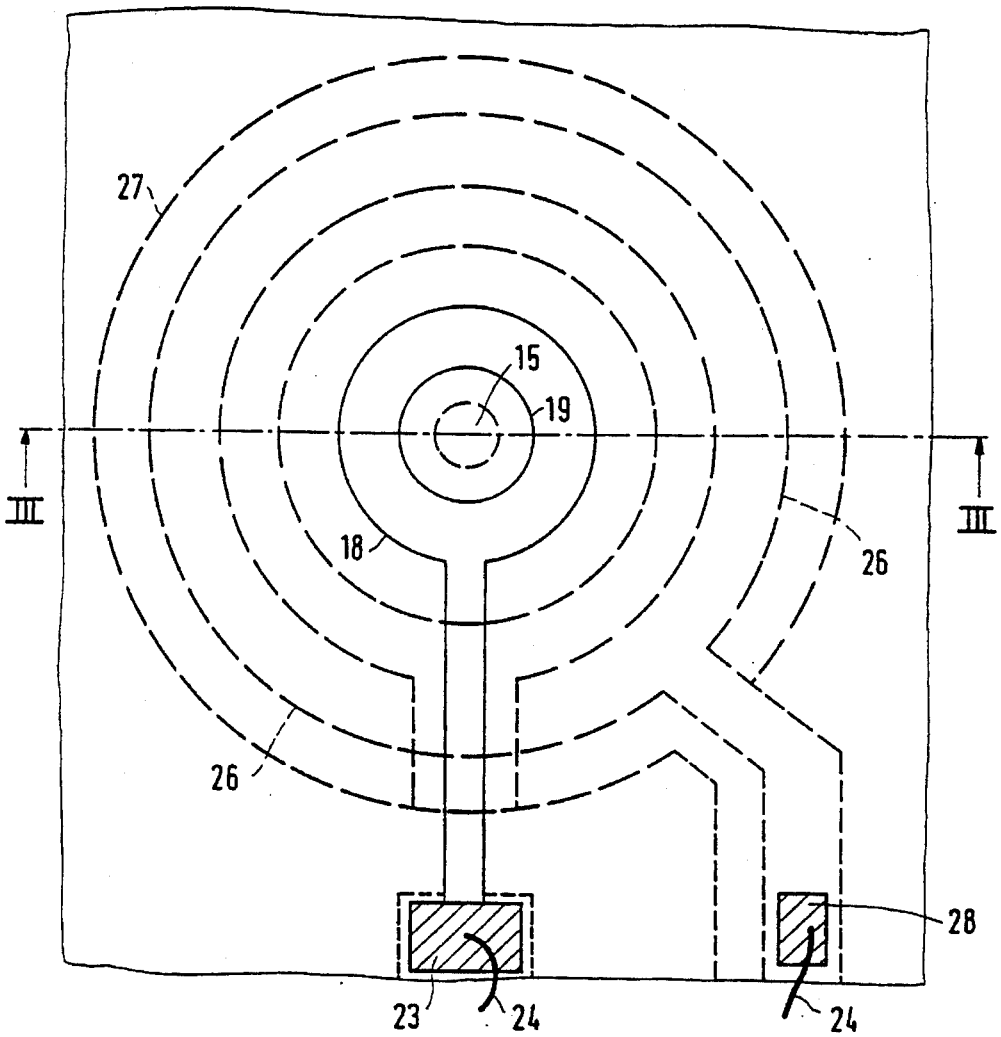
Figure 3:
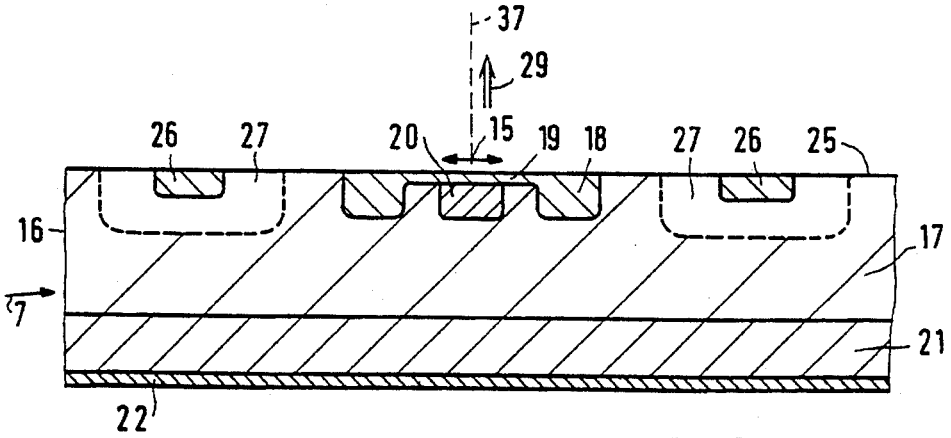
Figure 4:
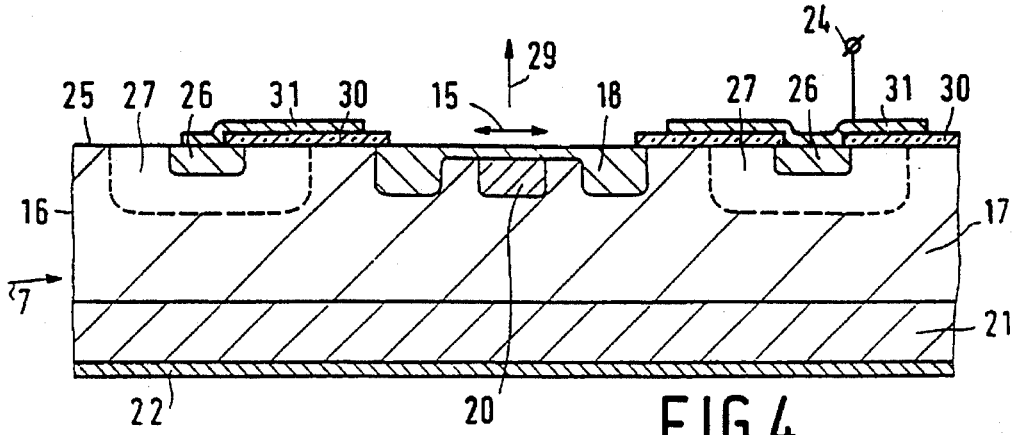
Figure 5:
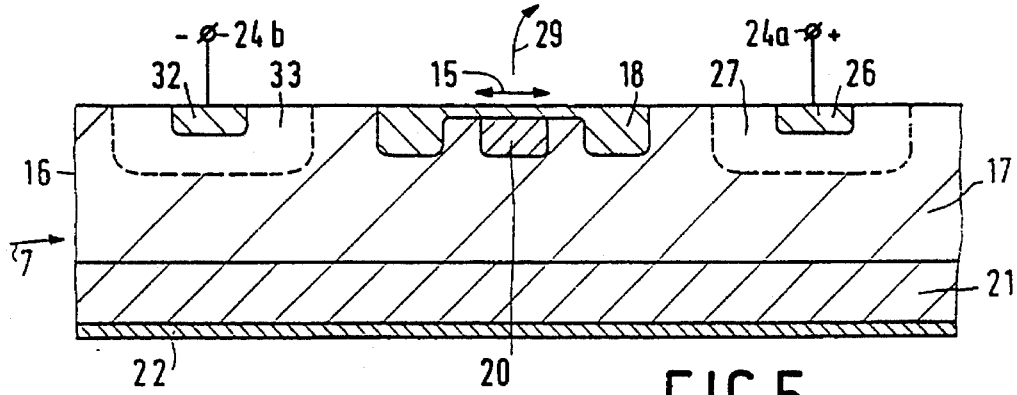
Figure 6:
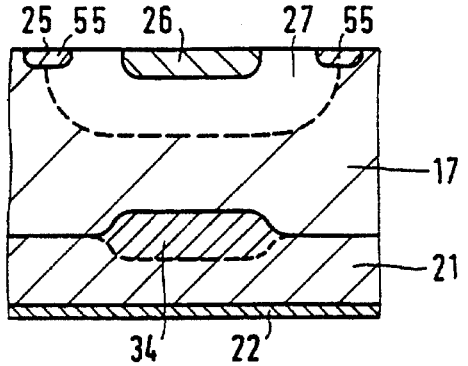
Figure 7:
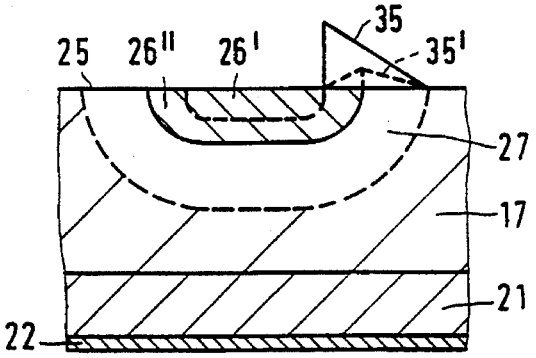
Figure 8:
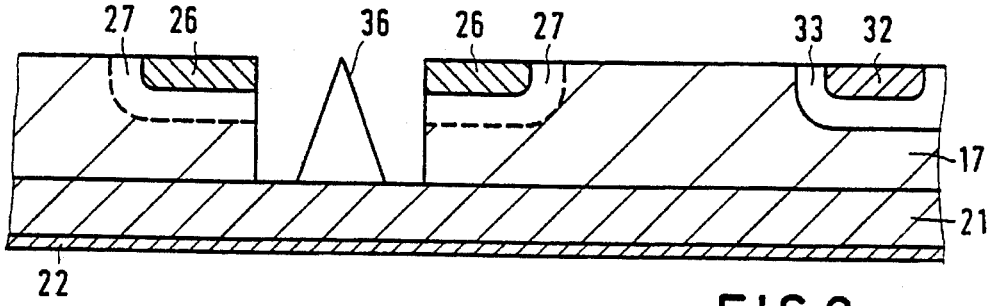
Figure 9:
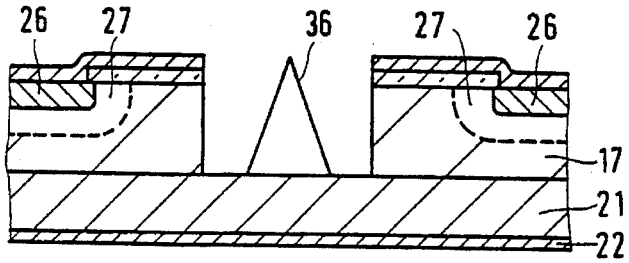
Figure 10:
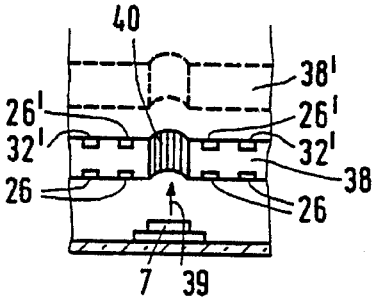
Figure 11:
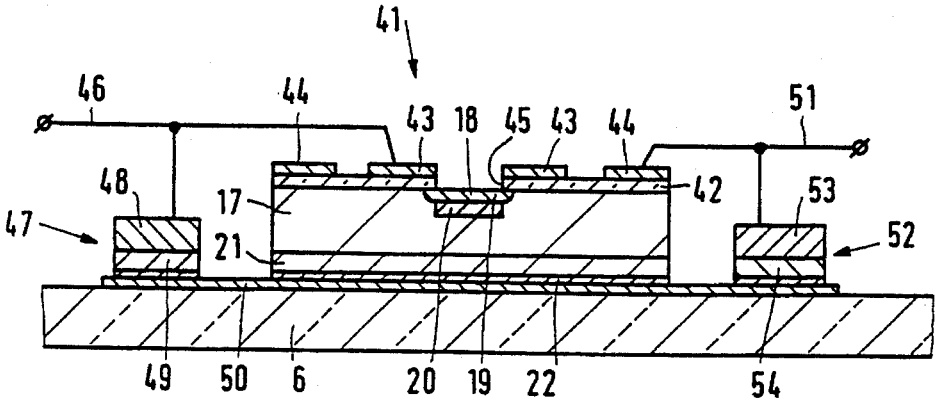

FIG. 1 shows diagrammatically a cathode ray tube,

FIG. 2 is a diagrammatic plan view and FIG. 3 is a diagrammatic cross-section taken on the line III—III in FIG. 2 of a semiconductor device for use in a device according to the invention, FIGS. 4 and 5 are diagrammatic cross-sections of other semiconductor devices for use in a device according to the invention, FIGS. 6 and 7 show modifications of the device of FIG. 3, while FIGS. 8 and 9 show embodiments of a semiconductor device for use as an electron source or ion source, FIG. 10 shows a realisation of electron-optical elements, and FIG. 11 shows diagrammatically a device in which a cold cathode and a protective structure are separately mounted on a support.

FIG. 1 shows diagrammatically an electron tube 1, in this case a cathode ray tube for picture display. This tube has a display window 2, a cone 3 and a neck portion 4 with an end wall 5. A support 6 with one or more cathodes 7, in this case semiconductor cathodes realised in a semiconductor body, is provided on the inner side on the end wall 5. The neck portion 4 accommodates a plurality of (in this case 4) grid electrodes 8, 9, 10 and 12. The cathode my tube further has a screen 11 at the location of the display window and, if necessary, deflection electrodes. Further elements associated with such a cathode my tube, such as deflection coils, shadow masks, etc. are omitted in FIG. 1 for the sake of simplicity. For electrical connection of, inter alia the cathode and the acceleration electrodes, the end wall 5 has leadthroughs 13 via which the connection wires for these elements can be electrically interconnected to terminals 14.

In the manufacturing process the cathode ray tube is subjected to a process step known as spot-knocking so as to remove burrs and dust particles. In this process step, for example grid 12 acquires a high voltage (approximately 40 kV) while the other grid electrodes are provided with pulsed or non-pulsed negative voltages of approximately −30 kV. Then flashovers may occur so that due to capacitive crosstalk between, for example the acceleration electrode 8 and the surface of the semiconductor body and gate electrodes provided on this body voltage peaks of approximately 100 V to approximately 2 kV or more are generated on this surface and the gate electrodes (also because the associated connection wire behaves as an inductance with respect to these voltage peaks at the rate at which they are generated). During operation the cathode is usually grounded while the electrodes 8, 9, 10 and 12 are maintained at voltages of 100 V, 2 kV, 8 kV and 30 kV, respectively. Such flashovers may occur also during this normal use, although the voltages at the acceleration electrodes do not necessarily occur in a rising sequence, as viewed from the cathode.

If the semiconductor cathode comprises a gate electrode, as is described in U.S. Pat. No. 4,303,930, which is separated from the subjacent semiconductor surface by an insulating layer, there will easily be breakdown (the destructive breakdown voltage of such a layer may vary between approximately 200 V and approximately 300 V). Consequently, there may not only be a short-circuit between the gate electrode and the semiconductor body, but silicon nitride associated with the insulating layer which is usually present to prevent absorption of cesium by silicon oxide may be attacked.

FIG. 2 is a plan view and FIG. 3 is a cross-section taken on the line III—III in FIG. 2 of a portion of a possible realisation of the semiconductor cathode 7 in which electrons are generated in the circular region 15. To this end the cathode 7 comprises a semiconductor body 16 (see FIG. 3) with a p-type substrate 17 of silicon in which an n-type region 18, 19 is provided on a main surface 25, which region consists of a deep diffusion zone or implanted region 18 and a thin n-type layer 19 at the location of the actual emissive region 15. To reduce the breakdown in this region, the acceptor concentration in the substrate is locally raised by means of a p-type region 20 provided by means of ion implantation. The n-type layer 19 has such a thickness that the depletion layer does not extend as far as the surface 25 in the case of breakdown of the pn junction between the regions 19 and 20 but is sufficiently thin to pass electrons generated by avalanche breakdown. To increase the emission, the electron-emissive surface may be provided, if necessary, with a mono-atomic layer of material decreasing the work function such as cesium. In this embodiment the substrate 17 is contacted via a highly doped p-type zone 21 and a metallization 22 while the n-type region 18 is connected via a contact metallization 23. The regions to be contacted are connected in the mounted state (see FIG. 1), for example via connection wires 24 to the leadthroughs 13 in the end wall 5.

In this embodiment the semiconductor body 16 also has a second structure at its main surface 25, which structure has a substantially closed annular region 26 of the n type which is highly doped ($10^{20}$ at/cm$^3$) and is present within a weakly doped surface region 27 of the p type. The latter region may alternatively be substantially intrinsic ($p^-$, $n^-$). The n-type region 26 is connected to a connection wire 24 via a contact metallization 28.

During use the n-type region may be brought to a positive voltage, for example to cause the beam 29 generated at the location of the region 15 to converge. For generating this beam the n-type region 18, 19 acquires, for example a voltage of 5.5 V, while the substrate voltage is maintained at 0 Volt. The n-type region 26 is connected, for example to a voltage of 20 V. With an acceptor concentration of approximately $5.10^{16}$ at/cm$^3$ of the p-type region 17 the breakdown voltage is approximately 25 V. During normal use the (zener) structure formed by the n-type region 26 and the substantially intrinsic or weakly doped p-type region 27 will thus not break down. The depletion layer associated with such a counter voltage has a width of approximately 0.3–1/ μm. By choosing the distance between the (zener) structure 26, 27 and the emissive structure 18, 19, 20 to be larger than 1 μm, a positive voltage on the main surface 25 at the location of the n-type region 26 will not influence the voltage across the emissive pn junction between the regions 19 and 20. A given voltage variation along the surface between the n-type region 26 and the p-type substrate 17 over the region 27 may even be advantageous from an electron-optical point of view in given cases because this reduces the field variations along the surface, which leads to better electron optics with lower aberrations.

If a high voltage is generated on the main surface 25 in the spot-knocking step during manufacture of the cathode ray tube, the structure 26, 27 protects itself from damage. At a (large) negative voltage the (zener) diode constituted by the regions 26, 27 is forward biased (the substrate 17 is connected to ground) so that the voltage is eliminated via conductance in the forward direction. At a (large) positive voltage there will be zener breakdown; in this case it is possible to convey sufficient current to remove large voltages. The same argument holds for the occurrence of voltages at the location of the n-type regions 18, 19 where the breakdown between these regions and the substrate 17 or the regions 20, 21 is decisive. Local increases or decreases of the voltage at the surface of the substrate have no influence because this substrate is connected to ground via the p-type region 21 and the metallization 22 and connection wires.

FIG. 4 is a diagrammatic cross-section of a device which is similar to that shown in FIG. 3. The main surface 25 is now partly coated with an insulating layer 30, for example of silicon oxide encapsulated by silicon nitride across which a metallization layer 31 extends which functions as a gate electrode. In contrast to the device of FIG. 3, the emissive beam is now exclusively influenced by the voltage at the electrode 31 and the electric field along the surface has no influence on the shape of the electron beam 29. The semiconductor regions 26 are now connected to the connection wire 24 via the metallization layer 31. The gate electrode 31 functions also as a field plate for the pn junction between the regions 26 and 27. The breakdown voltage of the (zener) diode is lower than that of the insulating layer 30 so that a possible increase of the voltage at the location of this gate electrode is compensated by passing the current through the (zener) diode. The insulating layer 30 may also partly cover the n-type region 26, as is shown in the left-hand part of FIG. 4. If the electron beam 29 is to converge with respect to the axis 37, the region 26 should be negatively biased with respect to the substrate 17 so that the zener diode constituted by the regions 26, 27 will convey current in the forward direction. The same applies if the n-type region 26 (hence also region 27) is divided into, for example two sub-regions having the shape of a hemisphere and if these sub-regions are given bias voltages of a different polarity to deflect the electron beam 29. One of the two pans will then start conducting.

FIG. 5 shows a cross-section of a device according to the invention in which this is prevented by realising a third structure on the main surface 25, which structure has a highly doped region 32 of the p type which is present within a weakly doped surface region 33 of the n type. The latter region may also be substantially intrinsic. Based on similar considerations as described above with reference to FIG. 3, there will be no breakdown at the main surface 25 in the case of an increase or decrease of the voltage because the (zener) structure constituted by the p-type region 32 and the surface region 33 will start conducting, if necessary. The acceptor concentration of the p-type region 32 is such again that the depletion layer is approximately 0.3–1 μm at a back voltage of 20 V. At a positive voltage across the connection wire 24$^a$ (which is shown diagrammatically) and a negative voltage at a connection wire 24$^b$ (which is also shown diagrammatically) which contacts the p-type region 32 via a contact metallization (not shown), the electron beam 29 is deflected into the direction of the positive voltage without one of the two zener structures being conducting. The other reference numerals denote the same components as in the previous embodiments.

The invention is of course not limited to the embodiments shown. For example, in the device of FIG. 5 the regions 26 and 34 can be connected in a similar manner as in FIG. 4 via an electrode separated by an insulating layer from the semiconductor body. Geometries for the zener structure 26, 27 which are different from the annular shape shown in FIG. 2 are, for example alternatively possible. These geometries may be defined both by the shape of the emissive region (for example rectangular in the case of a substantially linear emissive region) and by the desired electron-optical function (for example a division of the structure 26, 27 into a plurality of (n) sub-structures, for example for n-pole uses. For electron-optical reasons, the annular shape in FIG. 2 may be surrounded by one or more similar rings.

More generally, the emissive region may alternatively be formed by means of a reverse-biased pin diode or by a NEA cathode, or by any other suitable electron-generating structure, while other charged particles (positive or negative) may also be generated in the emissive region.

Various modifications of the zener structures 26, 27 and 32, 33 are alternatively possible.

For example, FIG. 6 shows a pan of the device of FIG. 3 in which the depletion layer of the (zener) diode 26, 27 along the surface of the semiconductor body is limited because the structure is provided with extra highly doped regions 55 constituting a "guard ring". Simultaneously, a buried layer 34 is present under the region 26 (viewed perpendicularly to the surface 25). This construction causes the current to be depleted directly (in a substantially vertical direction) via the regions 34, 21 and the metallization 22 in the case of breakdown. Instead of the structure shown, other structures such as pip and nin structures are alternatively possible, provided that the associated current/voltage characteristics are such that during normal use of the device these structures do not convey substantially any current or convey little current. Vertical pnpn or npnp structures (for example, breakover diodes) may alternatively be FIG. 7 shows a modification in which the surface region 26 is divided into a highly doped region 26' surrounded by a region 26" having a lower doping (shown by means of broken lines). It has been assumed that the depletion layer extends as far as the edge of the p-type region 27. In such a construction a division 35' of the electric field as denoted by the broken lines prevails above the surface 25 in the case of reverse bias, while the field division 35 is associated with an abrupt transition. For particle-optical reasons, the more gradually varying field distribution 35' is usually more favourable.

The semiconductor device may also be realised on an n-type substrate on which an n-type epitaxial layer is provided and on which a buried layer comparable to the p-type region 21 is provided which is contacted by means of a deep p-type diffusion region.

In the devices of FIGS. 8 and 9 the electron beam is obtained by means of field emission. To this end the semiconductor body is provided in generally known manner with a tapered (conical, pyramid-shaped) metal (molybdenum) or semiconductor structure 36 (field emitter). The other reference numerals in FIG. 8 denote the same components as in the other embodiments. Such structures may alternatively be used for generating ions whose paths can be influenced by voltages at the regions 26, 32.

The electron optics (and more generally particle optics) operated with the regions 26, 32 and associated structures is also applicable to particle sources and beams which are not generated in the semiconductor body or at its surface. For example, a semiconductor body may have an aperture for a particle source to be provided (or for passing a beam), the surface(s) of the semiconductor being provided again with similar structures as described above. Such a device is shown in FIG. 10. A beam generated by a cathode 7 is accelerated by means of voltages at, for example the regions 26 in a first semiconductor element 38 so that this beam passes the aperture 40. By means of voltages at the regions 26', 32' on the other surface the beam is, for example, subsequently collimated. If necessary, a plurality of such elements 38, 38' may consecutively influence the beam 39.

FIG. 11 shows a realisation of a device according to the invention in which a first semiconductor device 41 on a support 6 operates as a cold cathode which is analogous to that of the previous embodiments but whose main surface 25 now has an insulating layer 42 on which gate electrodes (acceleration electrodes, deflection electrodes) 43, 44 are provided. The insulating layer 42 has an aperture at the location of the actual electron-emissive region. The other reference numerals have the same significance as in the previous embodiments. The gate electrode 43 is given a positive voltage via a connection wire 46 which is connected to a diagrammatically shown (zener) diode 47 (with an $n^+$-type region 48 and a $p^-$-type region 49) or another suitable semiconductor structure which does not conduct at the operating voltage, but sufficiently conducts at such a high voltage between gate electrode and substrate that a destructive breakdown of the insulating layer may occur so that this voltage is depleted to a common connection 50. Similarly, the gate electrode 44 has a connection wife 51 for providing a negative voltage, which wife is connected to a diagrammatically shown (zener) diode 52 (with a $p^+$-type region 53 and an $n^-$-type region 54) which is arranged parallel between the gate electrode 44 and the metallization layer 22. Instead of the diodes 47, 52 other semiconductor structures having suitable symmetrical or asymmetrical current/voltage characteristics may be used in this case.

I claim:

1. A vacuum tube comprising a semiconductor device for influencing a path of charged particles, characterized in that the semiconductor body has a region for generating charged particles or an aperture for passing charged particles, and that for influencing the path of charged particles at least one main surface has at least one structure with a first surface region of a first conductivity type which is at least partly surrounded by a second surface region of a second, opposite conductivity type or is substantially intrinsic.

2. A vacuum tube as claimed in claim 1, characterized in that for influencing the path the main surface of the semiconductor body has at least one further structure with a first surface region of the second conductivity type which is surrounded by a second surface region of the first conductivity type or is substantially intrinsic.

* * * * *